US006300901B1

(12) United States Patent
Davidovitz et al.

(10) Patent No.: US 6,300,901 B1
(45) Date of Patent: Oct. 9, 2001

(54) COMPACT, MODULAR TILE ARCHITECTURE FOR LIMITED FIELD-OF-VIEW ARRAYS

(75) Inventors: Marat Davidovitz, Belmont; Peter Franchi, Winchester, both of MA (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/572,866

(22) Filed: May 18, 2000

(51) Int. Cl.[7] ..... H01Q 3/26
(52) U.S. Cl. ..... 342/373; 342/371
(58) Field of Search ..... 342/368, 371, 342/373, 375

(56) References Cited

U.S. PATENT DOCUMENTS 4,041,501 * 8/1977 Frazita et al. ..... 343/844
4,228,436 * 10/1980 DuFort ..... 343/854
4,321,605 * 3/1982 Lopez ..... 343/844
4,652,880 * 3/1987 Moeller et al. ..... 342/373
4,876,548 * 10/1989 Lopez ..... 342/368
5,546,095 * 8/1996 Lopez ..... 343/703

* cited by examiner

*Primary Examiner*—Dao Phan
(74) *Attorney, Agent, or Firm*—William G. Auton

(57) ABSTRACT

A compact, modular limited-scan phased array is disclosed. The entire array, combining the feed and the radiating elements, is fabricated as a multilayer, planar substrate structure, with vias incorporated as layer interconnects. Furthermore, the desired degree of control over the array pattern can be exercised by inclusion of additional feed circuit layers. The feed can be used in systems requiring limited scan in one of the principal scan planes and wide-angle scan in the other plane, as well as in phased arrays with limited field-of-view in both principal scan planes. The planar circuit implementation of the array makes in inherently amenable to integration with state-of-the-art solid-state active components.

1 Claim, 4 Drawing Sheets

Lopez Network Skobelev Network

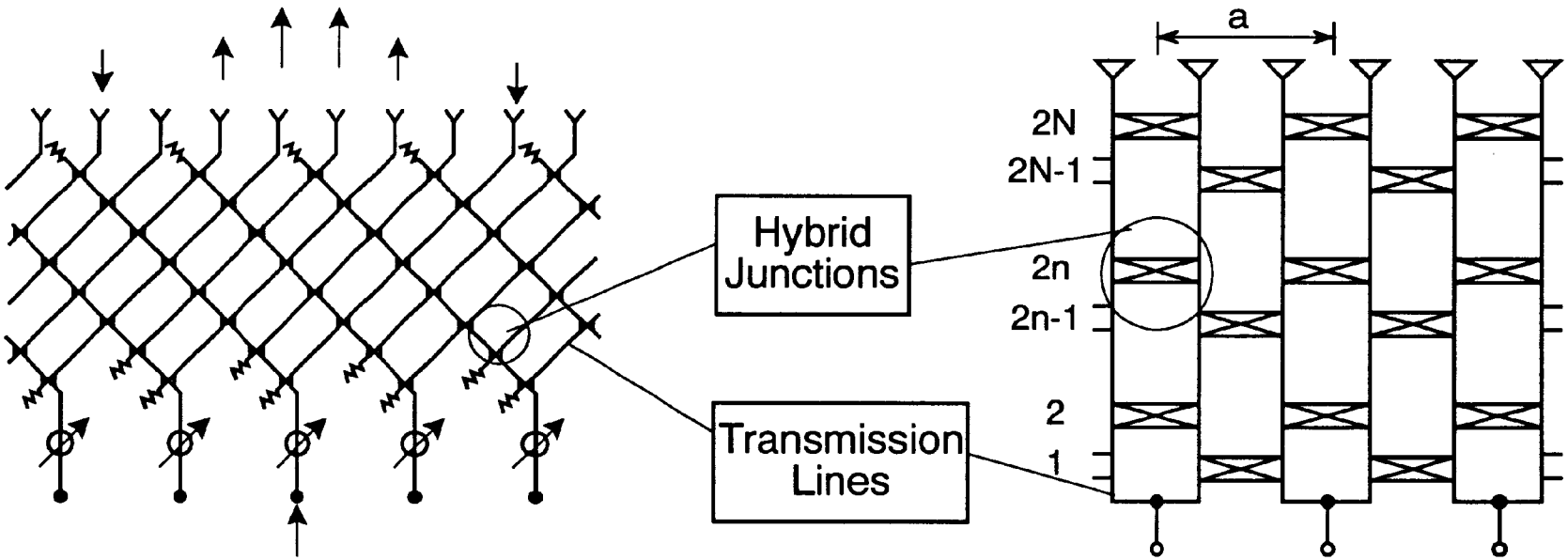
Fig. 2 Skobelev Network
Fig. 1 Lopez Network

Mask Layout for the Prototype Design

COMPACT, MODULAR TILE ARCHITECTURE FOR LIMITED FIELD-OF-VIEW ARRAYS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to array radiators, and more particularly the invention pertains to a means for providing a compact, modular limited-scan phased array by combining the feed and the radiating elements, which are fabricated as a multilayer, planar substrate structure, with vias incorporated as layer interconnects.

Most phased array antennas are designed for wide-angle scanning. This invention, however, addresses a specialized group of array systems that take advantage of restrictions in the scan coverage in order to produce a very-high-gain scanning system with relatively few phase controls, or that provide wide-band, wide-angle scanning performance for large apertures without an accompanying large number of time-delay controls.

The limited scan phased array antenna is best understood by the systems of: U.S. Pat. Nos. 3,938,160, 4,228,436, and 4,321,605 which are incorporated wherein by reference.

The first patent shows coupled array elements that are used in the present invention.

The second patent is the Lopez array antenna system that is also used in the present invention.

The third patent is for a limited scan phased array antenna, which is also used in the present invention.

The present invention improves the above-cited references by a design providing compactness, a transverse dimension of less that ½ free-space wavelength suitable for conformal integration and modularity, as discussed below.

SUMMARY OF THE INVENTION

The present invention includes a compact, modular limited-scan phased array. The entire array, combining the feed and the radiating elements, is fabricated as a multilayer, planar substrate structure, with vias incorporated as layer interconnects. Furthermore, the desired degree of control over the array pattern can be exercised by inclusion of additional feed circuit layers. The feed can be used in systems requiring limited scan in one of the principal scan planes and wide-angle scan in the other plane, as well as in phased arrays with limited field-of-view in both principal scan planes. The planar circuit implementation of the array makes it inherently amenable to integration with state-of-the-art solid-state active components.

In one embodiment of the invention, the switch includes a limited field-of-view array system which is made up of:

- an array of a plurality of two element modules which each receive overlapping feed signals to stimulate collective radiation of an output signal with a restricted degree of freedom; and
- a folded multilayer modular Lopez/Skobelev network which sends the overlapping feed signals to the array of two element modules.

It is an object of the present invention to provide modular limited scan phased array.

DESCRIPTION OF THE DRAWINGS

FIGS. 1 and 2 are, respectively, the Lopez and the Skobelev networks for limited field of view array feeds;

DETAILED DESCRIPTION OF THE PREFERRED EMBODIMENT

Figure 3:
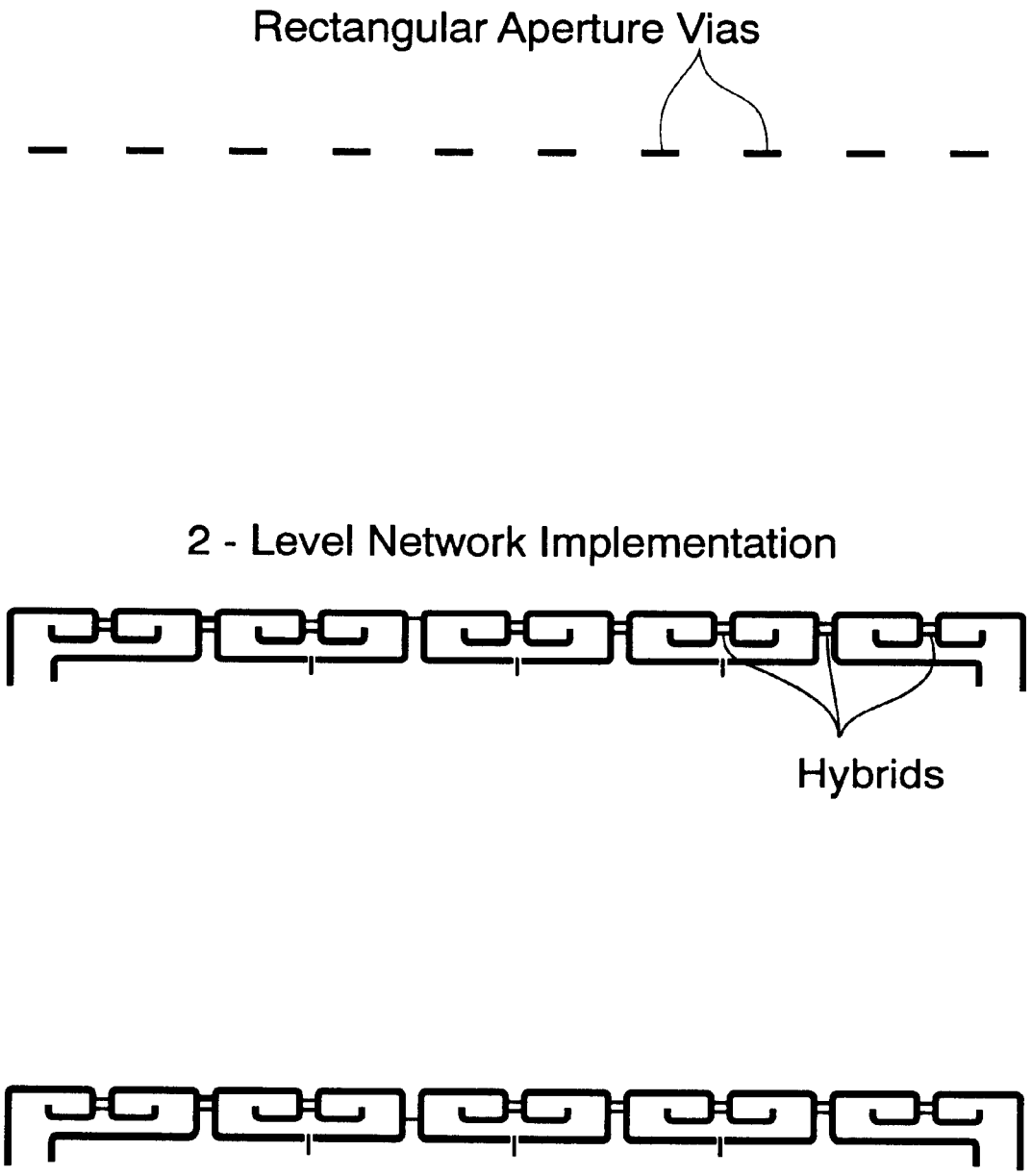
FIG. 3 are the masks used in the etching process of the circuit boards for the various components of the array, namely the antenna elements (microstrip patches), coupling vias (rectangular apertures in the ground plane of the microstrip antenna substrate) and the microstrip feed network made up of interconnected hybrids in the manner shown in FIGS. 1 and 2.

The present invention includes a compact, modular limited-scan phased array. The entire array, combining the feed and the radiating elements, is fabricated as a multilayer, planar substrate structure, with vias incorporated as layer interconnects. Furthermore, the desired degree of control over the array pattern can be exercised by inclusion of additional feed circuit layers. The feed can be used in systems requiring limited scan in one of the principal scan planes and wide-angle scan in the other plane, as well as in phased arrays with limited field-of-view in both principal scan planes. The planar circuit implementation of the array makes it inherently amenable to integration with state-of-the-art solid-state active components.

Shown in FIGS. 1 and 2 are, respectively, the Lopez and the Skobelev networks for limited field of view array feeds. The networks are identical in structure; they differ somewhat in the efficiency with which the available input/output ports are utilized. These networks are used to control the amplitude/phase distribution of a linear antenna array. The beam of the linear array is thereby scanned, or made to change its direction of maximum signal radiation in the plane parallel to the array line. In many applications the arrays are required to scan over a finite cone of directions. The additional degree of freedom needed to accomplish this is obtained by stacking the linear array columns adjacent to one another and in parallel, to create planar distributions of elements, or planar arrays.

A commonly encountered situation in practice calls for limited beam scan in the elevation plane—parallel to the column axis, and full scan in the orthogonal—azimuth plane. The limited scan specification for the elevation plane implies that each column is to be controlled by a limited scan feed network. To allow full scan while maintaining a single beam (avoiding grating lobes) in azimuth, the spacing between the columns has be maintained at around ½ free space wavelength. Therefore, each columns feed network must be confined to that transverse dimension. Moreover, in many air and space borne platforms, it is desirable to reduce the profile, or overall thickness, of the antenna array. This imposes further constraints on the depth of the volume into which the feed networks must be constrained.

The invention demonstrates an implementation of the Lopez/Skobelev limited scan array with the following characteristics:

1. Compactness:
   - Transverse dimension less than ½ free-space wavelength
   - Very small depth (low-profile, suitable for conformal integration)
   - Thin microstrip antenna elements are used as radiators 2. Modularity:

The precision of beam control depends on the number of degrees of freedom (DOF) inherent in the network. In the case of the network at hand, the DOF are the power division coefficients of the hybrid junction. The junctions are arranged in levels, numbered according to the scheme shown on the Skobelev schematic. It is clear that the number of DOF increases with the number of layers incorporated. The proposed design breaks the network up into successive two-level sub networks. Each sub network is implemented in practice on a single microstrip, stripling or other suitable planar wave guiding medium circuit board of transverse dimension less than ½ wavelength. The sub network boards can be added by stacking to increase the number of DOF to satisfy the given beam control requirements. Electrical signal propagation between the stacked circuit board layers is afforded by means of vias. These can be of either capacitively/electromagnetically coupled or coaxial probe types. The thickness of each circuit board constitutes a very small fraction of the electrical free space wavelength. Therefore even feed networks containing a stack of several sub networks are relatively thin.

3. Suitability for integration with integrated circuit components:

The planar circuit board implementation of the antenna array/feed network can be easily integrated with active phased array control components (amplifiers, oscillators, phase shifters, etc.), which can be placed on a layer separate and adjacent to the last layer of the array feed network.

Figure 4:
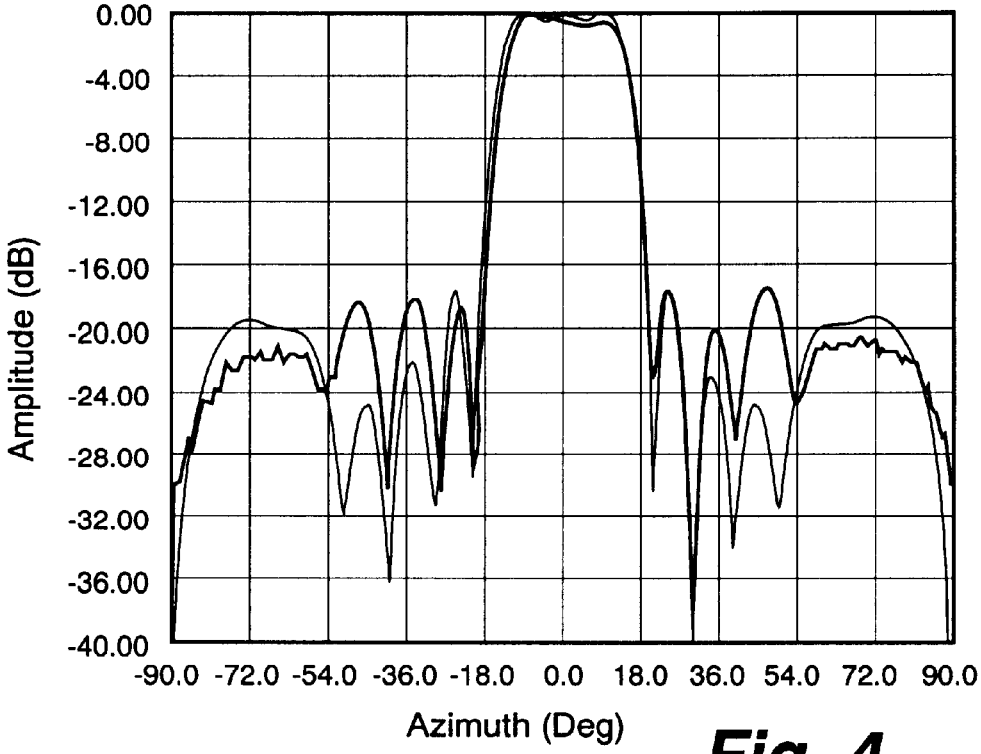
FIG. 4 is a detailed chart of measured element pattern.
Figure 5:
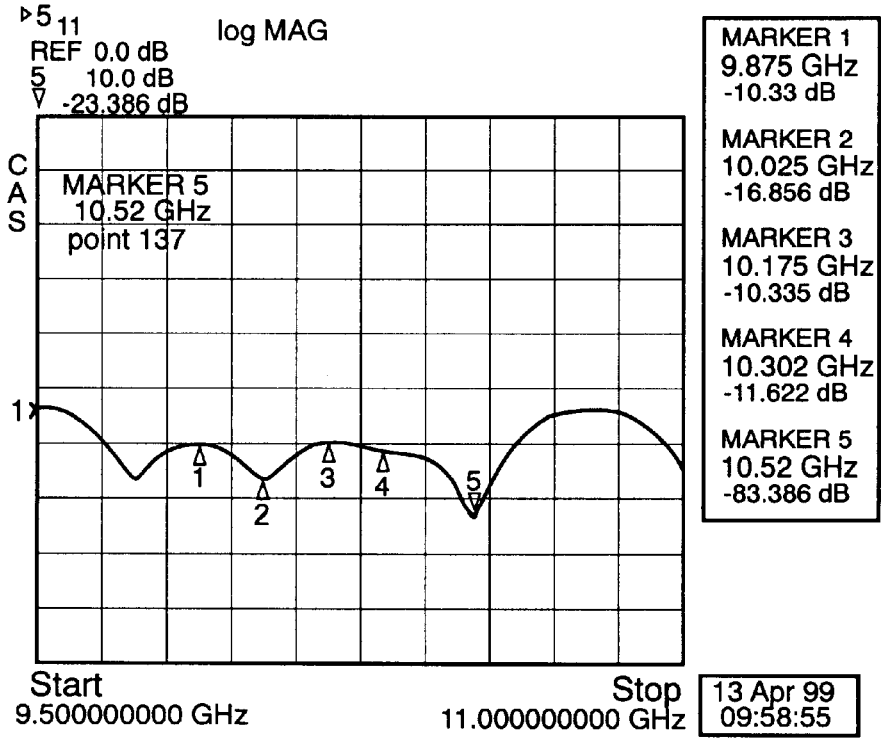
FIG. 5 is a detailed chart of the return loss of the array of the invention.
Figure 6:
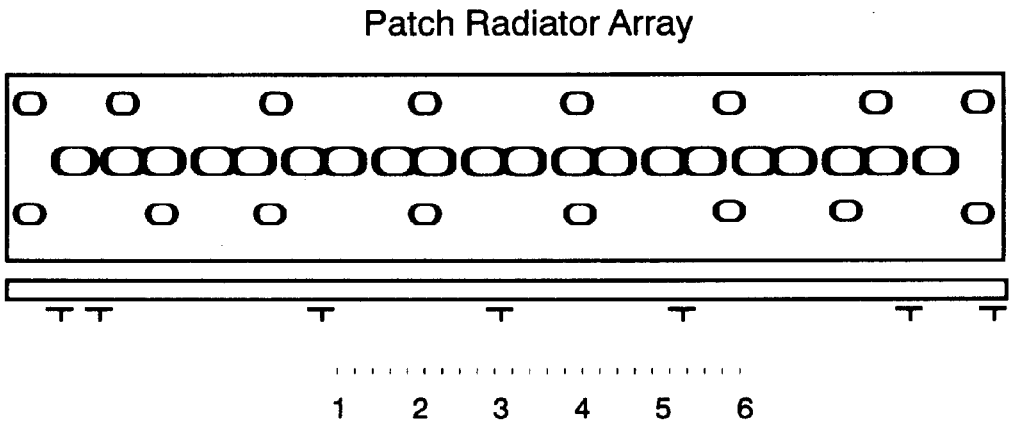
FIG. 6 is a plan view of the patch radiator array.
Figure 7:
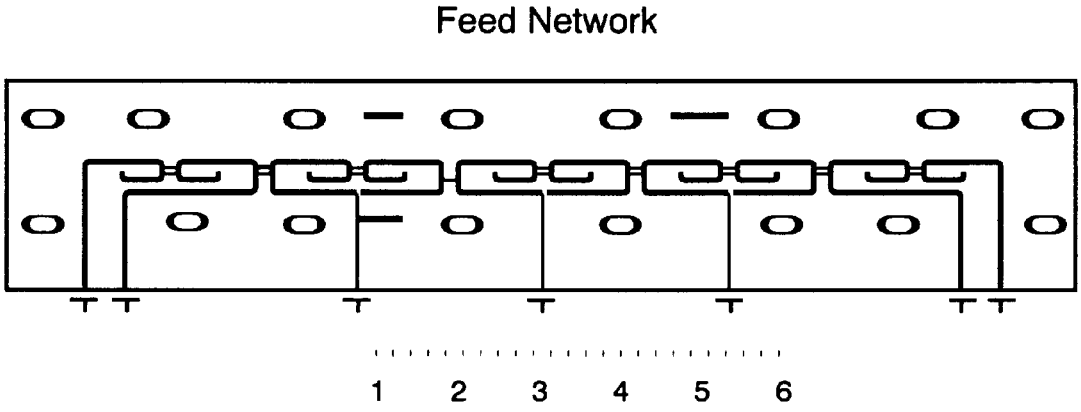
FIG. 7 is a plan view of the feed network.

A prototype array was constructed to verify the claims. Shown in FIG. 3 are the masks used in the etching process of the circuit boards for the various components of the array, namely the antenna elements (microstrip patches), coupling vias (rectangular apertures in the ground plane of the microstrip antenna substrate), and the microstrip feed network made up of interconnected hybrids in the manner shown in FIGS. 1 and 2. The feed network embodies a two-level version of the Skobelev scheme. Shown below are the photos of the antenna and feed network layers used in testing. The array was tested to obtain the element pattern, defined as the radiation pattern of the array with only one input excited, with others terminated in matched loads. The element pattern exhibits the required "flat-topped" characteristic and low side-lobes. The input return loss is very low over a significant band of frequencies. FIGS. 4 and 5 are charts of array performance.

While the invention has been described in its presently preferred embodiment it is understood that the words which have been used are works of description rather than words of limitation and that changes within the purview of the appended claims may be made without departing from the scope and spirit of the invention in its broader aspects.

What is claimed is:

1. A limited field of view array system comprising:

an array of a plurality of two element modules which each receive overlapping feed signals, these overlapping feed signals means that each element receives feed signals from at least two sources so that adjacent elements have radiating apertures that overlap to stimulate a collective radiation of an output signal with a restricted decree of freedom wherein said array radiates a signal of wavelength; and a folded, multilayer modular Lopez/Skobelev network which sends the overlapping feed signals to the array of two element modules wherein said array of two element modules and folded multilayer modular Lopez/Skobelev network have a combined transverse depth of less than ½ wavelength.

* * * * *